US009945552B2

(12) United States Patent
Johnson et al.

(10) Patent No.: US 9,945,552 B2
(45) Date of Patent: Apr. 17, 2018

(54) FLASHLIGHT WITH BOTTLE OPENER

(71) Applicant: Spectrum Brands, Inc., Middleton, WI (US)

(72) Inventors: Andrew David Johnson, Monona, WI (US); Joshua Gerald Bauer, Brooklyn, WI (US); Christina Y. Prestidge-Kadrlik, Madison, WI (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 15/145,553

(22) Filed: May 3, 2016

(65) Prior Publication Data

US 2017/0321876 A1 Nov. 9, 2017

(51) Int. Cl.

| | |
|---|---|
| ***F21V 33/00*** | (2006.01) |
| ***F21V 7/00*** | (2006.01) |
| ***F21V 5/04*** | (2006.01) |
| ***F21L 4/00*** | (2006.01) |
| ***F21V 17/10*** | (2006.01) |
| ***F21V 23/04*** | (2006.01) |
| ***B67B 7/16*** | (2006.01) |
| *F21Y 101/02* | (2006.01) |

(52) U.S. Cl.

CPC ..... *F21V 33/0036* (2013.01); *B67B 7/16* (2013.01); *F21L 4/005* (2013.01); *F21V 5/04* (2013.01); *F21V 7/00* (2013.01); *F21V 17/10* (2013.01); *F21V 23/0428* (2013.01); *F21Y 2101/02* (2013.01)

(58) Field of Classification Search

CPC .. B67B 7/16; B67B 7/066; B67B 7/44; F21V 21/0885; F21V 21/145; F21V 33/0024; F21V 33/0036

USPC ..... 362/109

See application file for complete search history.

(56) References Cited

U.S. PATENT DOCUMENTS

| | | | | |
|---|---|---|---|---|
| 7,313,983 | B1 * | 1/2008 | Book | B67B 7/16 81/3.07 |
| D660,487 | S | 5/2012 | Wu | |
| D686,475 | S | 7/2013 | Wu | |
| 2002/0166176 | A1 * | 11/2002 | Cohen | B67B 7/16 7/151 |
| 2005/0174764 | A1 * | 8/2005 | Thuma | B26B 11/001 362/199 |
| 2010/0085739 | A1 * | 4/2010 | Webb | B26B 1/02 362/157 |
| 2011/0072594 | A1 * | 3/2011 | Danias-Borkin | B25F 1/04 7/155 |
| 2011/0136555 | A1 * | 6/2011 | Ramies | B67B 7/16 455/575.8 |
| 2015/0162712 | A1 * | 6/2015 | Yan | B67B 7/16 439/501 |

OTHER PUBLICATIONS

Photograph 1.

* cited by examiner

*Primary Examiner* — Thien M Le
(74) *Attorney, Agent, or Firm* — Banner & Witcoff, Ltd.

(57) ABSTRACT

A flashlight, or portable light source, that has a light source at one end and a bottle opener at the second end. The bottle opener may be secured to the body of the flashlight in a permanent or removable manner. The bottle opener may be secured to the body of the flashlight by a cap on the end opposite the light source.

22 Claims, 7 Drawing Sheets

FLASHLIGHT WITH BOTTLE OPENER

FIELD OF INVENTION

The field of invention for this disclosure is a portable light source, or flashlight, that also functions as a bottle opener.

BACKGROUND

Flashlights provide a portable and easily transportable light source. Since the flashlight is portable, if the flashlight provided any additional functionality this would be a great benefit to a user as they would need to carry fewer items. A flashlight that can also serve as a bottle opener provides the additional functionality desired.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this disclosure relate to a flashlight comprising a body having a first end, a second end opposite the first end, and a center section spaced between the first end and the second end; a primary light source located at the first end; and a bottle opener located at the second end. The bottle opener may have a front surface, a top surface, a rear surface and side surfaces, and an opening through the front surface and rear surface. The top surface and side surfaces of the bottle opener may have a portion made of a polymer material and the front surface may be a metallic material. The polymer material on the top and side surfaces of the bottle opener may be a polycarbonate. The flashlight may further comprise a reflector and a lens, and the primary light source may be a light emitting diode. The bottle opener may be secured to the body by a cap and may be removably connected to the body. The flashlight may have an overall length of the flashlight in a range of 140 mm to 170 mm and also may have a ratio of an overall length of the flashlight to an overall length of the bottle opener within a range of 5.5:1 and 7:1. The flashlight may further comprise a secondary light source within the center section of the flashlight, and the center section of the body may have a clear exterior surface. Lastly, the bottle opener may have a tooth that includes a rear surface that is offset a fixed distance and parallel to the front surface of the bottle opener.

Another aspect of this disclosure relates to a flashlight comprising a body having a first end, a second end opposite the first end, and a center section positioned between the first end and the second end; a light source positioned at the first end; and a bottle opener positioned at the second end, where the bottle opener may protrude through a cap that secures the bottle opener to the body. The bottle opener may further comprises a front surface, a top surface, a rear surface and side surfaces, an opening centered on a longitudinal centerline of the body; and wherein the opening extends through the front surface and the rear surface. The top surface, the rear surface, and side surfaces of the bottle opener may be a polymer. Additionally, the first end of the body may have a width greater than a width of the second end of the body.

Yet another aspect of this disclosure relates to a flashlight comprising a body having a first end, a second end opposite the first end, and a center section positioned between the first end and the second end; a primary light source, a reflector, and a lens positioned at the first end; a bottle opener positioned at the second end; and a secondary light source positioned in the center section of the body. The bottle opener may be secured to the body by a cap that is molded onto the body. Also, the bottle opener may have a first arm and a second arm, where the first arm is longer than the second arm. Lastly, the bottle opener may have an opening centered upon a longitudinal centerline of the body forming a plurality of interior surfaces and wherein a portion of one of the interior surfaces may be made of a polymer.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

"Generally perpendicular" means that a first line, segment, plane, edge, surface, etc. is approximately (in this instance, within 5%) oriented approximately 90 degrees from another line, plane, edge, surface, etc., over at least 50% of the length of the first line, segment, plane, edge, surface, etc.

In the following description of the various embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made without departing from the scope and spirit of the present disclosure.

In general, as described above, aspects of this invention relate to a flashlight having a light source at one end and a bottle opener positioned at the other end. More detailed descriptions of aspects of this invention follow.

Figure 1:
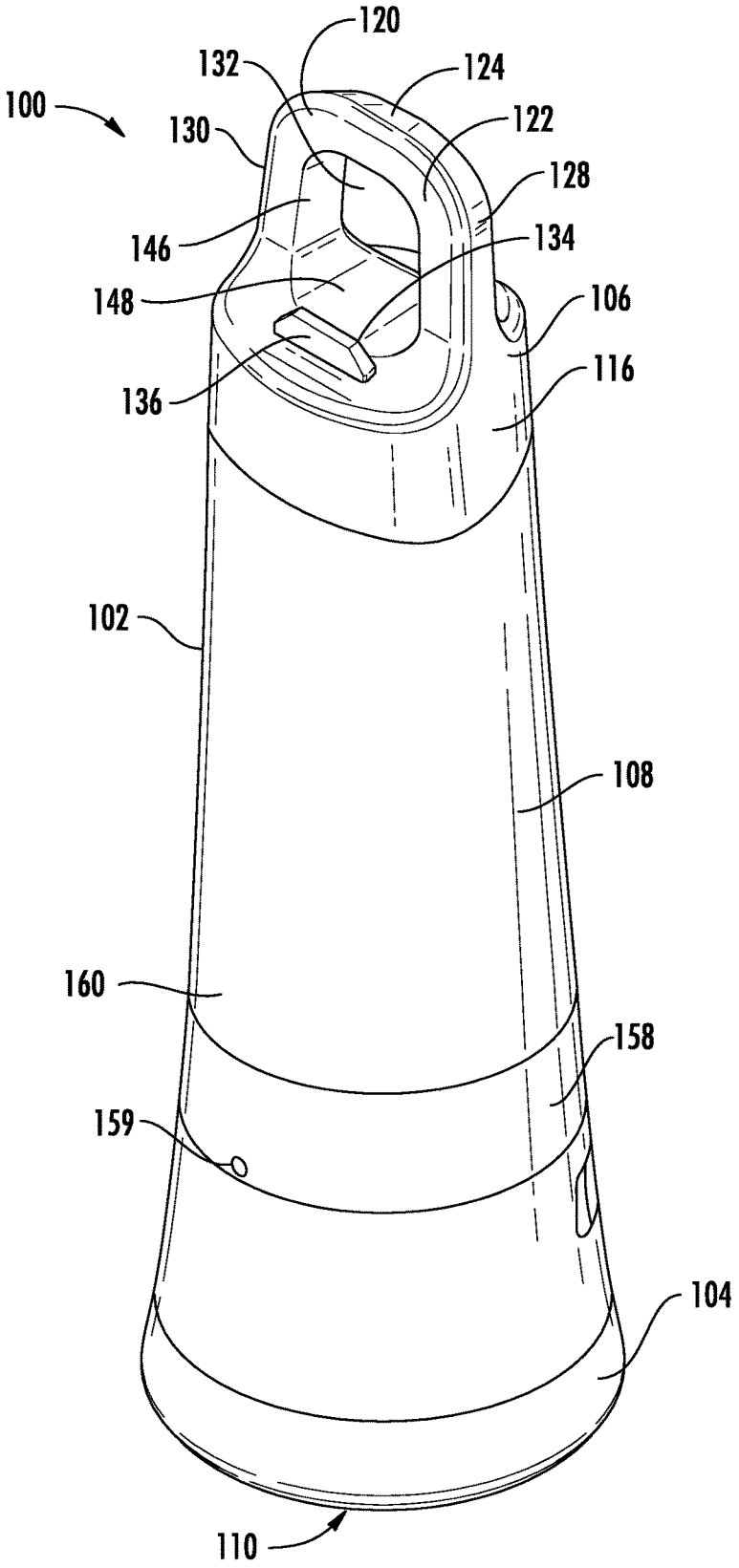
FIG. 1 illustrates a top front perspective view of an example embodiment of a flashlight according to one or more aspects described herein.
Figure 2:
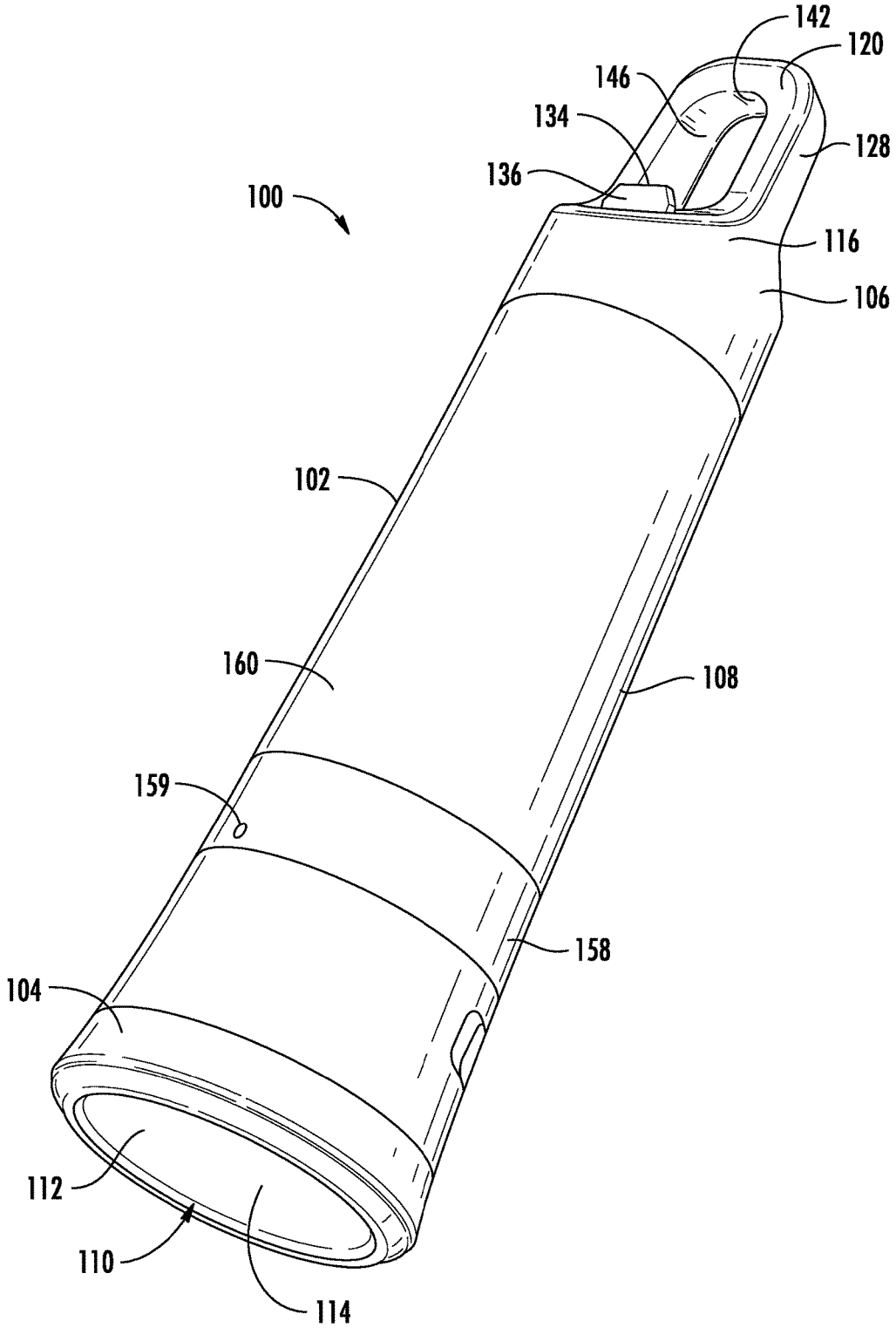
FIG. 2 illustrates a bottom front perspective view of an example embodiment of a flashlight according to one or more aspects described herein.
Figure 3:
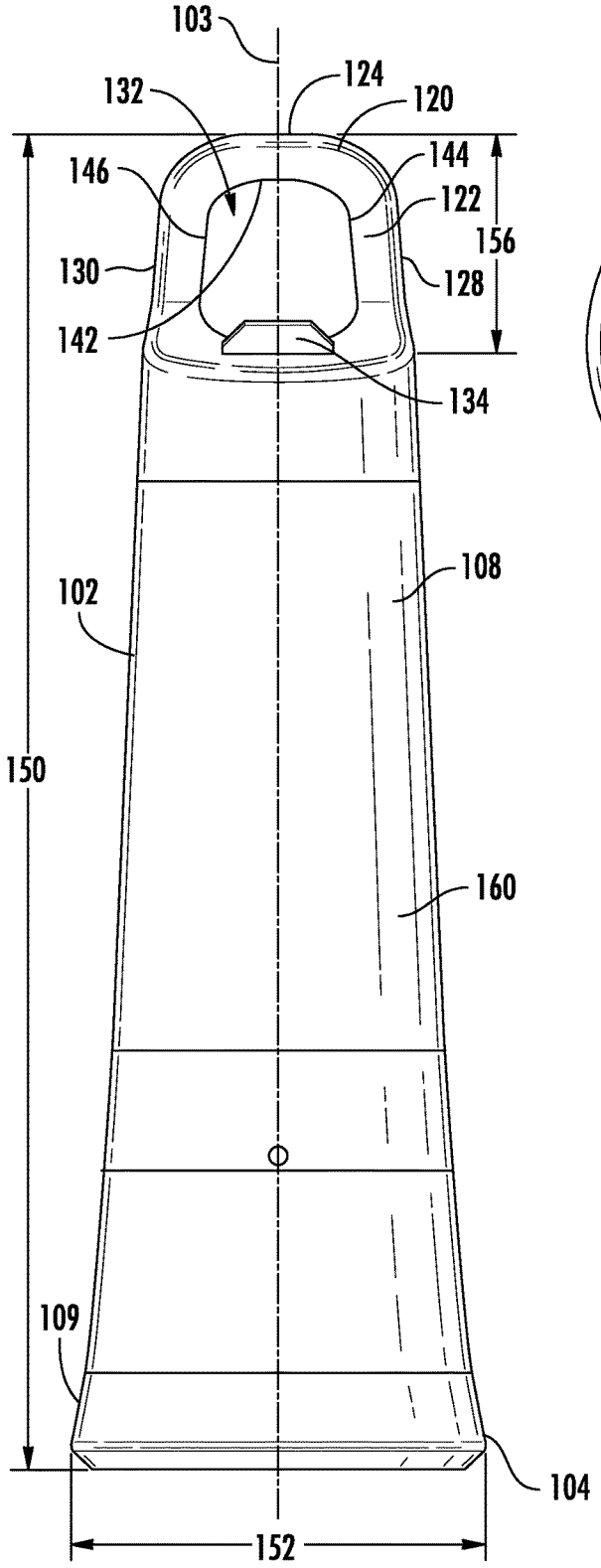
FIG. 3 illustrates a front view of the example embodiment of the flashlight of FIG. 1.

One aspect of this invention relates to a flashlight 100, as shown in FIGS. 1 and 2, which may have a body 102, a first end 104, a second end 106 opposite the first end 104, and a center section 108 positioned between the two ends. A light source 110 may be positioned at the first end 104 and a bottle opener 120 may be located at the second end 106. The light source 110 may be a light emitting diode. The light source 110 may be other light sources capable of providing light.

The flashlight 100 may further comprise a reflector 112 and a lens 114 located at the first end 104. The reflector 112 and lens may increase the amount of light created by the light source 110 and the flashlight 100. The reflector 112 may be made of a polymer material such as polycarbonate material with a bright chrome finish. The lens 114 similarly may be made of a polymer such as a polycarbonate material with a transparent finish.

The second end 106 may include a cap 116 along with the bottle opener 120. The bottle opener 120 may protrude from the cap 116. Additionally, the cap 116 may secure the bottle opener 120 to the flashlight 100.

Figure 4:
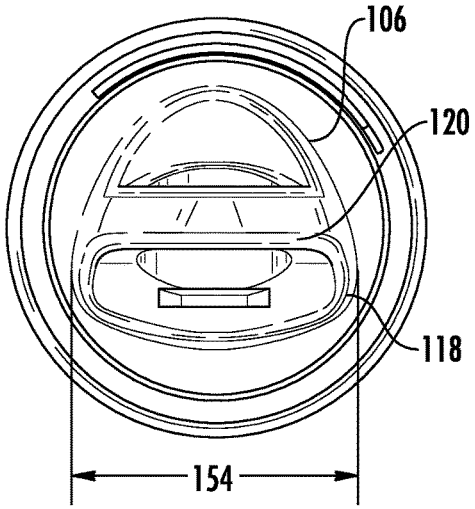
FIG. 4 illustrates a top view of the example embodiment of the flashlight of FIG. 1.
Figure 5:
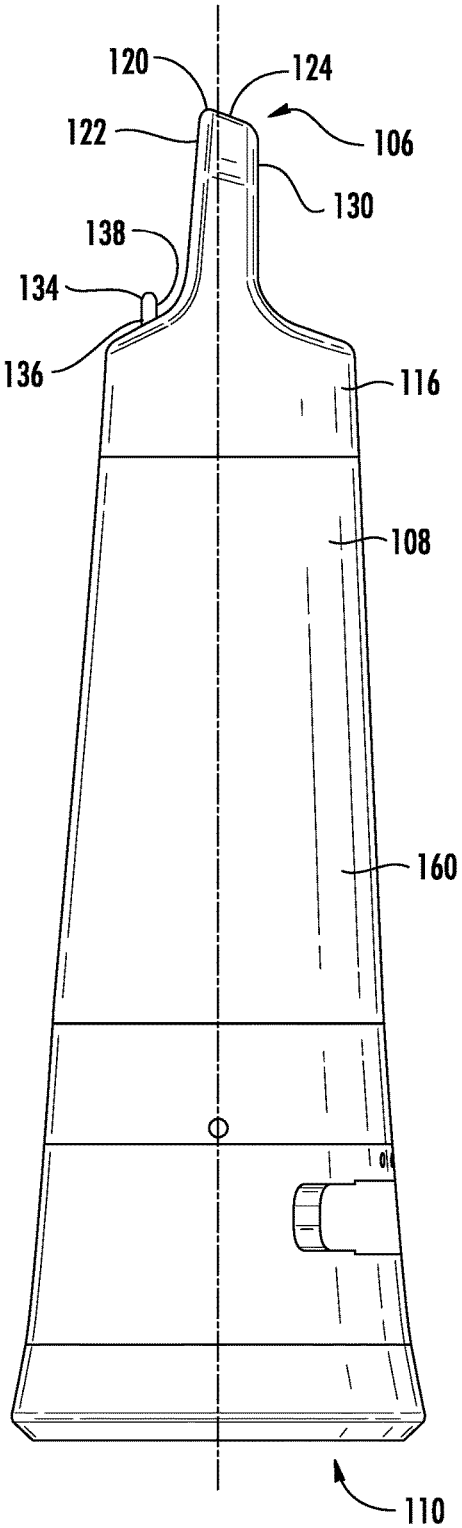
FIG. 5 illustrates a side view of the example embodiment of the flashlight of FIG. 1.
Figure 6:
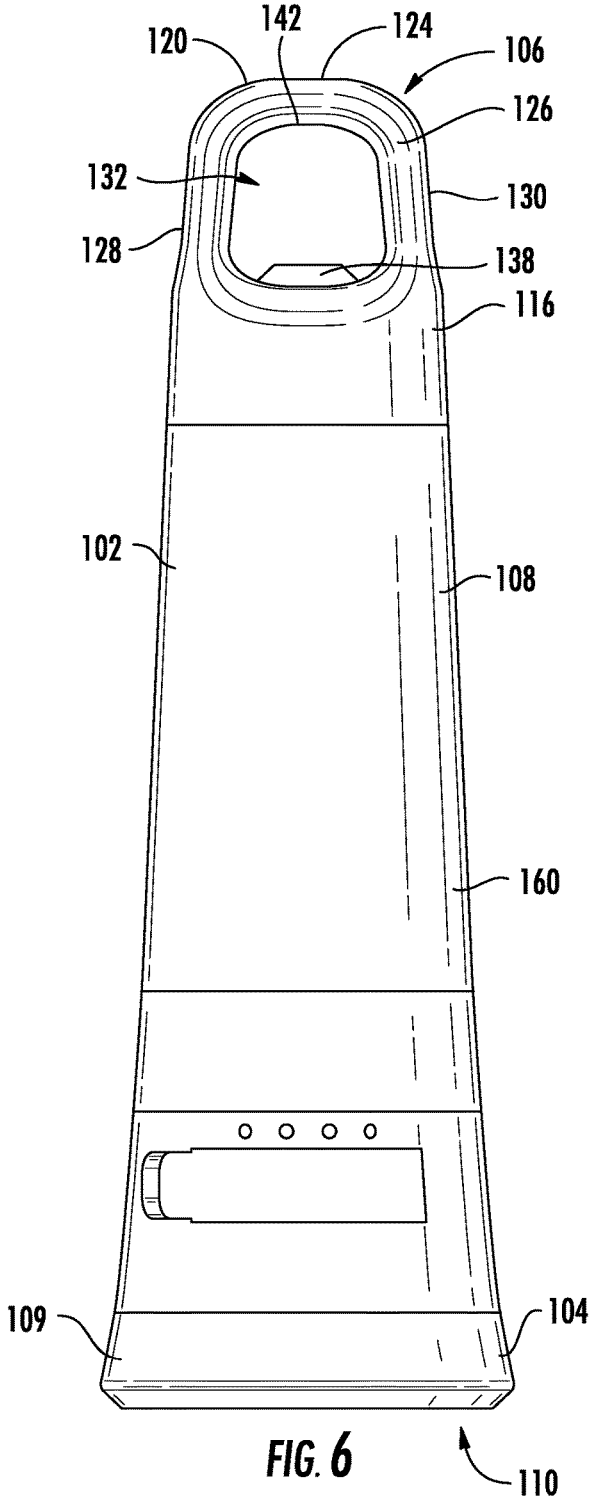
FIG. 6 illustrates a rear view of the example embodiment of the flashlight of FIG. 1.

As discussed above and shown in FIGS. 1-6, the body 102 may have a first end 104 and a second end 106. The first end 104, which includes the light source 110 may have any shape. For example, the body 102 in the embodiment shown in FIGS. 1 and 2 has a first end 104 with a circular shape. However, the first end 104 may be a square, rectangular, triangular, oval or any shape. Similarly, the second end 106 which defines the cap 116 may have any shape as well, such as a triangular shape as shown in the embodiment shown in FIG. 4 or may have a square, circular, oval, or any shape. Further, if either of the first end 104 or second end 106 have a non-rounded shape, the corners may have a fillet radii 118, as also shown in FIG. 4 at the corners of the triangular shaped second end 106, to provide a smooth transition and avoid any sharp corners.

The first end 104 and second end 106 may be any size, but are preferably sized to fit in a user's hand. For example, the first end 104 may a have a maximum width, defined as the maximum width 152 at the furthest extent across of the first end 104, within a range of 40 mm to 60 mm or 25 mm and 65 mm. Similarly, the second end 106 may have a maximum width 154, defined as the maximum width of the cap 116 within a range of 25 mm and 35 mm or 20 mm and 40 mm. The maximum width of the cap 116 may be measured at the top surface of the cap 116 where the bottle opener 120 protrudes from the surface of the cap 116. The first end 104 may have a maximum width 152 that is greater than a maximum width 154 of the second end 106. Alternatively, the maximum width 152 of the first end 104 may be the same width as the maximum width 154 of the second end 106 or the maximum width 152 may be less than the maximum width 154.

Additionally, an overall length 150 of the flashlight 100 may be defined as the length of the first end 104 to a top surface 124 of the bottle opener 120. The overall length 150 may be in a range of 140 mm to 170 mm. The overall length 156 of the bottle opener 120 may be defined as the length from the top surface 124 of the bottle opener 120 to where the bottle opener 120 protrudes from the top surface of the cap 116. The flashlight 100 may have a ratio of the overall length 150 of the flashlight 100 to an overall length 156 of the bottle opener 120 within the range of 5.5:1 and 7:1.

Figure 9:
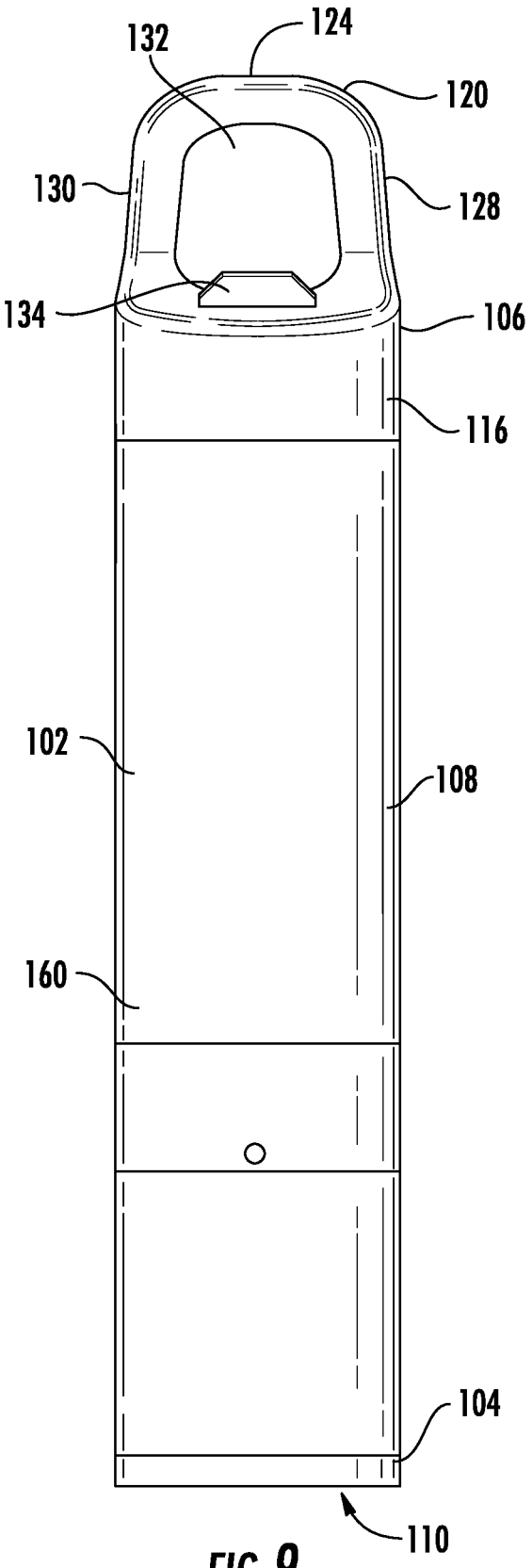
FIG. 9 illustrates another example of an embodiment of the flashlight according to one or more aspects described herein.

The flashlight 100 may have any shape. For example, the body 102 may have a smooth continuous curvature that changes gradually from the profile or shape of the first end 104 to the shape or profile of the second end 106 similar to the example embodiment shown in FIGS. 1-6. The body 102 may have a flared section 109 near the first end 104 as shown in FIGS. 1-6. Alternatively, the body 102 may have discrete sections that form a corner or edge where the sections join. As another embodiment, the body 102 may have a constant width or diameter as shown in FIG. 9 where the first end 104 and the second end 106 have the same width.

The bottle opener 120 may be defined as an apparatus used to open a beverage container that is sealed with a bottle cap. As discussed above, the bottle opener 120 may be positioned at the second end 106 of the body 102. The bottle opener may have a front surface 122, a top surface 124, a rear surface 126, and side surfaces 128, 130, and an opening 132 through the front surface 122 and the rear surface 126. Additionally, the bottle opener 120 may further comprise a tooth 134 that has a front surface 136 and a rear surface 138. The rear surface 138 may be generally parallel to and oppose the front surface 136 of the tooth 134. The rear surface 138 may be offset a fixed distance from the front surface 122. The tooth 134 may also have a substantially flat top surface 140.

The opening 132 may be centered and symmetrical about a longitudinal centerline 103 of the body 102 and may form a plurality of interior surfaces defining an upper interior surface 142, side interior surfaces 144, 146, and a lower interior surface 148. The opening 132 may have any shape such as generally trapezoidal, square, or rectangular where the upper interior surface 142 may be a flat or linear surface. Alternatively, opening 132 may have a rounded shape with a flat upper interior surface 142. The opening 132 may be appropriately sized to have the side interior surfaces 144, 146 have a width to fit over the bottle cap. The maximum width of the opening 132 may be greater than a width of the tooth 134.

The side surfaces 128, 130 of the bottle opener 120 may have a curvature that is the same as the curvature of the cap 116 to give the appearance that the bottle opener 120 has a seamless appearance with the geometry of the cap 116. Alternatively, the side surfaces 128, 130 may have a curvature that is different than the curvature of the cap 116 where a break in the geometry is visible.

The body 102 may be formed of a first material, and the cap 116 may be formed of a second material different than the first material or formed of the same material that may be dyed a different color. In one example embodiment, the body 102 may be formed of multiple components made of the same material with various portions that are formed of the same material that may be dyed a different color. The cap 116 may be formed from the same material as the body 102 using an overmolding technique to secure it to the body 102. For example, the body 102 and the cap 116 may both be made of a polycarbonate material.

As discussed, the cap 116 may be overmolded onto the body 102 and secure the bottle opener 120 to the flashlight 100. The bottle opener 120 may be formed as a separate part and then placed in the mold prior to forming the cap 116. The cap 116 may then be formed by molding over a portion of the bottle opener 120 to form a mechanical lock around the bottle opener 120. The bottle opener 120 may be permanently connected using this overmolding technique or other may be secured using other mechanical means such as fasteners or adhesives.

Figure 8:
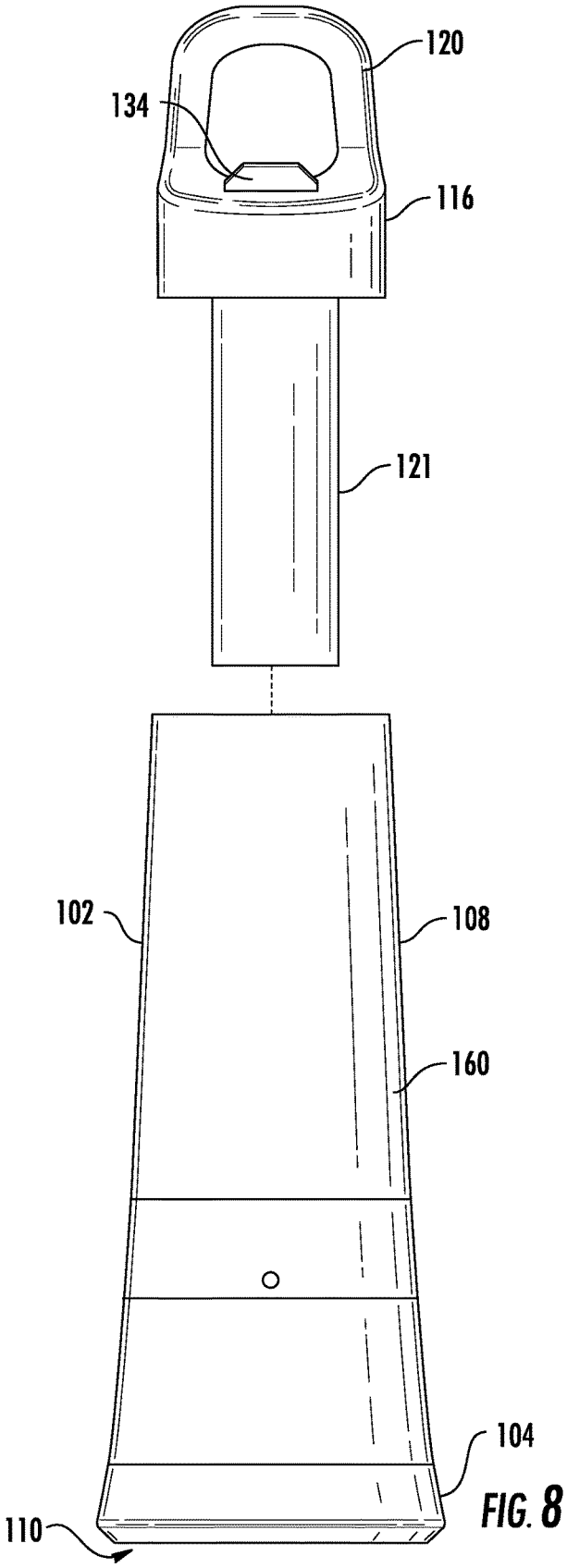
FIG. 8 illustrates another example of an embodiment of the flashlight according to one or more aspects described herein.

Alternatively, the bottle opener 120 may be removable from the flashlight 100, as shown in the embodiment shown in FIG. 8. In this example embodiment, the bottle opener 120 may have a releasable mechanical connector such that the bottle opener is removable. The removable portion may comprise only the bottle opener 120 or a combination of the cap 116 and bottle opener 120. The removable portion may further comprise a handle 121 that may extend from the cap 116.

The bottle opener 120 may be formed of a metallic material, such as a stainless steel. However, the top surface 124, the rear surface 126, and the side surfaces 128, 130 of the bottle opener 120 may be a polymeric material, while the front surface 122 may be metallic. The polymeric material may be the same material as the cap 116 such as polycarbonate. These interior surfaces 142, 144, 146, 148 may have a portion formed of a metallic material and a portion formed of a polymer. Alternatively, these interior surfaces 142, 144, 146, 148 may be all metallic or all polymer. The tooth 134 may be formed of a stainless steel material and have exposed surfaces being metallic.

The body 102 may be may manufactured from any materials such as polymers or metals. The body is preferably made of materials with a density within a range of 4.6 g/cc to 1.0 g/cc or within a range of 2.8 g/cc to 1.1 g/cc. The body 102 may be made of a plurality of materials where the body 102 is made of a plurality of components. The components may be made of separate pieces that are joined together or may be formed at different stages such as molding the components in multiple stages using such techniques as overmolding to create the different components and textures found on the body 102.

The flashlight 100 may further comprise a secondary light source 160 within the center section 108 of the body 102. The secondary light source 160 may extend over a majority of the overall length of the flashlight 100. The secondary light source 160 may be a light emitting diode. When the secondary light source 160 is present, the center section 108 of the body 102 may include a clear exterior surface and may be made of a transparent or translucent material.

The flashlight 100 may also feature a switch 158 to allow a user to adjust and control the light source 110 on the flashlight 100. The switch 158 may allow the user to turn on or off the light source 110. The switch 158 may also allow the user to switch between different light levels for the light source 110. Additionally, the switch 158 may allow the user to adjust and control the light source between the primary light source 110 and the secondary light source 160. For example, the switch may control or adjust only the primary light source 110 active to only with the secondary light source 160 active or an option having both the primary light source 110 and the secondary light source 160 active. The switch 158 may be positioned closer to the first end 104 than the second end 106. Also, the switch 158 may rotate or slide around the body 102 with an exterior surface made of a material different than that of the body 102 to provide the user a different feel and texture. The switch 158 may also include an indicator 159 to communicate to the user the location of the switch 158. Additionally, the switch 158 may have an exterior surface made of a thermoplastic elastomer (TPE), while the body 102 may be made of a different polymer such as polycarbonate.

FIGS. 7A-7E shows some alternate embodiments of the bottle opener 120. The bottle opener 120 may be configured without the tooth 134 as shown in example embodiments of 7A and 7B. For example, FIG. 7A may comprise an opening 132 of a trapezoidal shape without the tooth or 7B comprising a circular opening with a flat surface on the bottom edge.

Figure 7A:
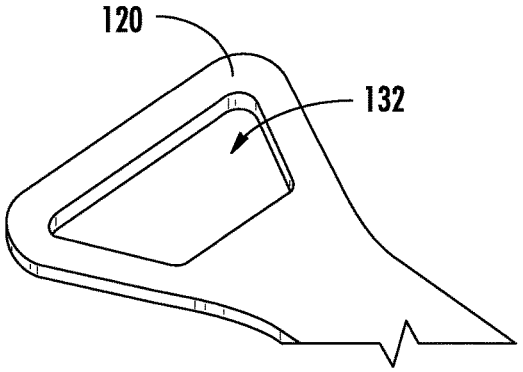
FIGS. 7A-7E illustrates examples of alternate embodiments of the bottle opener end of the example embodiment of the flashlight of FIG. 1.
Figure 7B:
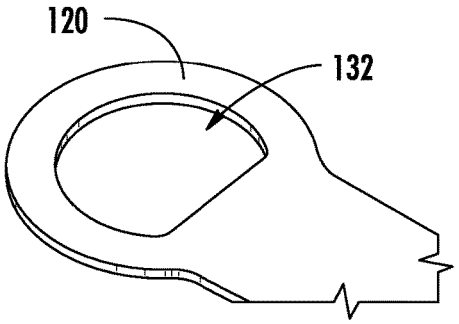
Figure 7C:
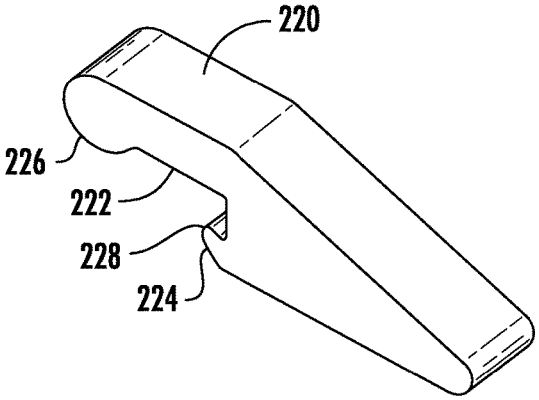
Figure 7D:
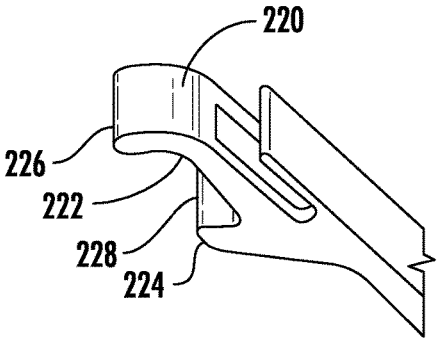

FIGS. 7C and 7D show an alternate embodiment of bottle opener 120. For the embodiment of FIGS. 7C and 7D, the features of the bottle opener 220 are referred to using similar reference numerals under the "2XX" series of reference numerals, rather than "1XX" as used in the embodiment of FIGS. 1-6. Accordingly, certain features of the bottle opener 120 and the flashlight 100, that were already described above with respect to bottle opener 120 of FIGS. 1-6 may be described in lesser detail, or may not be described at all. FIGS. 7C and 7D show alternate embodiments where the bottle opener 220 comprises a shape having a pair of arms 222, 224 where the first arm 222 is longer than the second arm 224. The second arm 224 is generally parallel to the first arm 222 and is spaced a distance offset from the first arm 222. Both the first arm 222 and the second arm 224 may have a curved end portion 226, 228 respectively.

Figure 7E:
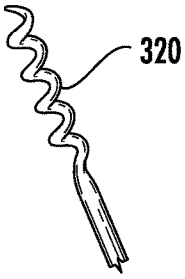

FIG. 7E shows an alternate embodiment of bottle opener 120. For the embodiment of FIG. 7E, the features of the bottle opener 320 are referred to using similar reference numerals under the "3XX" series of reference numerals, rather than "1XX" as used in the embodiment of FIGS. 1-6. Accordingly, certain features of the bottle opener 120 and the flashlight 100, that were already described above with respect to the bottle opener 120 of FIGS. 1-6 may be described in lesser detail, or may not be described at all. Another alternate embodiment of the bottle opener 120 may have a corkscrew 320 type features instead of the bottle opener 120 shown in FIG. 7E. The corkscrew 320 may have a cover (not shown) to protect the user from any sharp edges.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A flashlight comprising:

a body having a first end with a circular shape, a second end opposite the first end, and a center section spaced between the first end and the second end;

a primary light source located at the first end;

a bottle opener located at the second end;

wherein the bottle opener has a front surface, a top surface, a rear surface and side surfaces, and an opening extending through the front surface and rear surface, wherein the opening is centered along a longitudinal centerline of the body;

wherein the bottle opener has a tooth that includes a rear surface that is spaced away and offset a fixed distance from the front surface of the bottle opener, and wherein the rear surface of the tooth faces the front surface of the bottle opener and is positioned at an angle to the front surface of the bottle opener.

2. The flashlight of claim 1, wherein the top surface and side surfaces have a portion made of a polymer material and the front surface is a metallic material.

3. The flashlight of claim 2, wherein the polymer material is a polycarbonate.

4. The flashlight of claim 1, wherein the primary light source is a light emitting diode.

5. The flashlight of claim 1, wherein the bottle opener is secured to the body by a cap.

6. The flashlight of claim 1, wherein the bottle opener is removably connected to the body.

7. The flashlight of claim 1, further comprising a reflector and a lens.

8. The flashlight of claim 1, wherein an overall length of the flashlight is in a range of 140 mm to 170 mm.

9. The flashlight of claim 1, wherein a ratio of an overall length of the flashlight to an overall length of the bottle opener is within a range of 5.5:1 and 7:1.

10. The flashlight of claim 1, wherein the flashlight further comprises a secondary light source within the center section of the flashlight.

11. The flashlight of claim 1, wherein the center section of the body has a clear exterior surface.

12. The flashlight of claim 1, wherein the front surface of the bottle opener is positioned at an angle to the longitudinal centerline of the body.

13. A flashlight comprising:

a body having a first end with a circular shape, a second end opposite the first end, and a center section positioned between the first end and the second end;

a light source positioned at the first end; and a bottle opener positioned at the second end;

wherein the bottle opener protrudes through a cap and the cap secures the bottle opener to the body, wherein an overall length of the flashlight is in a range of 140 mm to 170 mm; and wherein a ratio of the overall length of the flashlight to an overall length of the bottle opener is within a range of 5.5:1 and 7:1.

14. The flashlight of claim 13, wherein the bottle opener further comprises a front surface, a top surface, a rear surface and side surfaces, an opening centered on a longitudinal centerline of the body; and wherein the opening extends through the front surface and the rear surface.

15. The flashlight of claim 14, wherein the top surface, the rear surface and side surfaces of the bottle opener are a polymer.

16. The flashlight of claim 13, wherein the first end of the body has a width greater than a width of the second end of the body.

17. A flashlight comprising:

a body having a first end with a circular shape, a second end opposite the first end, and a center section positioned between the first end and the second end;

a primary light source, a reflector, and a lens positioned at the first end;

a bottle opener positioned at the second end; and a secondary light source positioned in the center section of the body, wherein the secondary light source extends over a majority of an overall length of the flashlight.

18. The flashlight of claim 17, wherein the bottle opener is secured to the body by a cap that is molded onto the body.

19. The flashlight of claim 18, wherein the bottle opener has a first arm and a second arm and wherein the first arm is longer than the second arm.

20. The flashlight of claim 17, wherein the bottle opener has an opening centered upon a longitudinal centerline of the body forming a plurality of interior surfaces and wherein a portion of one of the interior surfaces is made of a polymer.

21. A flashlight comprising:

a body having a first end with a circular shape, a second end opposite the first end, and a center section spaced between the first end and the second end;

a primary light source located at the first end;

a bottle opener located at the second end that is secured to the body by a cap; wherein the bottle opener has a front surface, a rear surface and a side surface, and an opening through the front surface, wherein the opening is centered along a longitudinal centerline of the body; and wherein the side surface has a curvature that matches a curvature of the cap; and wherein the bottle opener has a tooth that includes a front surface and a rear surface, wherein the rear surface is offset a fixed distance from the front surface of the bottle opener.

22. The flashlight of claim 21, wherein a ratio of an overall length of the flashlight to an overall length of the bottle opener is within a range of 5.5:1 and 7:1.

* * * * *